US008656935B2

(12) United States Patent
Kato et al.

(10) Patent No.: US 8,656,935 B2
(45) Date of Patent: Feb. 25, 2014

(54) THIN PLATE MEMBER WASHING APPARATUS

(75) Inventors: Yusuke Kato, Sunrise, FL (US); Takanobu Yamauchi, Kyoto (JP); Kei Asai, Otsu (JP); Makoto Tabata, Kyoto (JP); Yusaku Sakoda, Shiojiri (JP)

(73) Assignee: Omron Healthcare Co., Ltd., Muko-Shi (JP)

( * ) Notice: Subject to any disclaimer, the term of this patent is extended or adjusted under 35 U.S.C. 154(b) by 0 days.

(21) Appl. No.: 13/524,703

(22) Filed: Jun. 15, 2012

(65) Prior Publication Data

US 2012/0279533 A1 Nov. 8, 2012

Related U.S. Application Data

(63) Continuation of application No. PCT/JP2010/073837, filed on Dec. 29, 2010.

(30) Foreign Application Priority Data

Jan. 8, 2010 (JP) ..... 2010-003037

(51) Int. Cl.
*B08B 3/12* (2006.01)
*B08B 6/00* (2006.01)

(52) U.S. Cl.
USPC ..... 134/184; 134/197

(58) Field of Classification Search
USPC ..... 134/184, 197
See application file for complete search history.

(56) References Cited

U.S. PATENT DOCUMENTS

| | | | | |
|---|---|---|---|---|
| 2,519,654 | A * | 8/1950 | Heaney | 134/103.1 |
| 3,894,551 | A | 7/1975 | Stohlman | |
| 5,167,323 | A | 12/1992 | Ohta et al. | |
| 5,181,604 | A | 1/1993 | Ohta et al. | |
| 5,328,601 | A | 7/1994 | Schmidt et al. | |
| 6,502,589 | B1 | 1/2003 | Fitzgerald et al. | |
| 7,484,515 | B1 | 2/2009 | Bluestone et al. | |
| 2004/0089331 | A1 * | 5/2004 | Yeh | 134/198 |
| 2004/0194817 | A1 | 10/2004 | Pope et al. | |
| 2005/0257816 | A1 | 11/2005 | Kim | |

FOREIGN PATENT DOCUMENTS

| | | |
|---|---|---|
| JP | U-4-077124 | 7/1992 |
| JP | A-6-296939 | 10/1994 |
| JP | A-7-39841 | 2/1995 |
| JP | U-3007442 | 2/1995 |
| JP | A-08-064571 | 3/1996 |
| JP | A-09-162152 | 6/1997 |
| JP | A-11-090359 | 4/1999 |
| JP | A-2000-216125 | 8/2000 |
| JP | A-2001-178639 | 7/2001 |
| JP | A-2001-340817 | 12/2001 |
| JP | A-2005-341880 | 12/2005 |

(Continued)

OTHER PUBLICATIONS

International Search Report issued in International Patent Application No. PCT/JP2010/073837 dated Apr. 12, 2011.

(Continued)

*Primary Examiner* — Jason Ko
(74) *Attorney, Agent, or Firm* — Oliff & Berridge, PLC

(57) ABSTRACT

In a thin plate member washing apparatus, when a rotary arm member supporting a mesh member holding portion is rotated using a rotary handle, tap water flows over the surface of a mesh member, and medicinal fluid residue deposited on the mesh member is removed.

3 Claims, 14 Drawing Sheets

(56) References Cited

FOREIGN PATENT DOCUMENTS

| | | |
|---|---|---|
| JP | A-2007-125266 | 5/2007 |
| JP | A-2007-324509 | 12/2007 |
| JP | A-2009-218402 | 9/2009 |
| WO | WO 96/18463 A1 | 6/1996 |

OTHER PUBLICATIONS

Apr. 12, 2011 International Search Report issued in International Patent Application No. PCT/JP2010/073836 (with translation).
Apr. 12, 2011 International Search Report issued in International Patent Application No. PCT/JP2010/073838.
Jan. 31, 2013 Office Action issued in U.S. Appl. No. 13/540,076.
U.S. Appl. No. 13/540,076, filed Oct. 25, 2012.
U.S. Appl. No. 13/432,827, filed Oct. 4, 2012.
Dec. 7, 2012 Office Action issued in U.S. Appl. No. 13/432,827.
Jun. 25, 2013 Notification of Reasons for Refusal issued in Japanese Patent Application No. 2010-003037 (with English Translation).
Chinese Office Action issued in Chinese Patent Application No. 201080060289.6 dated Dec. 5, 2013 (w/ translation).

* cited by examiner

THIN PLATE MEMBER WASHING APPARATUS

This is a Continuation of International Application No. PCT/JP2010/073837 filed Dec. 29, 2010, which claims the benefit of Japanese Application No. 2010-003037 filed Jan. 8, 2010. The disclosures of these applications are hereby incorporated by reference herein in their entireties.

TECHNICAL FIELD

The present invention relates to a thin plate member washing apparatus for washing a thin plate member.

BACKGROUND ART

There is technology of vibrating a mesh member composed of a thin plate member made of metal or other materials in which multiple minute holes are formed and spraying fine particles of liquid. As a specific example, such technology is applied to atomizers (nebulizers or inhalers) used to administer drugs for asthma and the like by inhalation. It is desired that the mesh member is kept clean, especially in the case of nebulizers, because nebulizers are used for inhalation of medicinal fluid. Moreover, for example, in the case where a viscous medicinal fluid is used, washing after use is required so as to prevent clogging of the minute holes with the medicinal fluid sticking to the mesh member.

Typical examples of the method of washing the mesh member include: (a) a method of washing the mesh member by filling a medicinal fluid bottle of a nebulizer with tap water and spraying the tap water for a few minutes (washing by spraying water) and (b) a method of washing the mesh member by directly exposing a mesh portion to flowing tap water (washing with flowing water).

However, the method (a) of washing by spraying water consumes the battery of the nebulizer, resulting in a decrease in the time period before battery replacement is required. Care needs to be taken because it is undesirable for a user or other person to inhale the atomized water. Moreover, washing takes a lot of time and labor.

In the case of the method (b) of washing with flowing water, when washing is performed by directly exposing the mesh portion to flowing tap water, the mesh member may be damaged and deformed as a result of exposure to a strong stream of flowing water, because the mesh member often is a thin plate so that micromachining can be performed and clogging can be prevented. There also is a risk that the force of the water may cause the mesh member to be dropped from the hand and the mesh member may be washed down the drain.

The background art of the thin plate member washing apparatus for washing a mesh member or the like according to the present invention has been described based on common technical information in the art that has become known to the applicant of the present invention, but as far as the applicant remembers, the applicant does not have any information that should be disclosed as prior art literature information before the filing of the present application. Note that a technology of washing rice or cereals using the force of flowing tap water is disclosed in JP 2001-178639A, "Water Flow Type Rice Washer and Cereal Washer" (Patent Literature 1), although this technology belongs to a technical field different from the thin plate member washing apparatus. Also, a technology of washing parts while rotating them is disclosed in JP 6-296939A, "Washing Machine for Parts" (Patent Literature 2).

CITATION LIST

Patent Literature

Patent Literature 1: JP 2001-178639A
Patent Literature 2: JP 6-296939A

SUMMARY OF INVENTION

Technical Problem

Problems to be solved by the present invention are attributed to the non-existence of an apparatus for washing a thin plate member. Therefore, an object of the present invention is to provide a thin plate member washing apparatus that can efficiently wash a thin plate member without causing damage to the thin plate member.

Solution to Problem

A thin plate member washing apparatus according to the present invention includes a lid member, a washing vessel having a top end opening that can be closed by the lid member and in which a liquid can be collected, a thin plate member fixing portion that is supported in the washing vessel and can hold a thin plate member to be washed with the liquid, and a liquid flow generation means that is provided on the lid member of the washing vessel and generates a liquid flow over a front surface and a back surface of the thin plate member in order to wash the thin plate member.

In another form of the thin plate member washing apparatus, the liquid flow generation means includes a rotation mechanism that generates the liquid flow over the front surface and the back surface of the thin plate member by rotating the thin plate member fixing portion about a rotation center shaft in the washing vessel.

Moreover, in another form, the washing vessel includes the circular lid member and a cylindrical vessel having a top end opening that can be closed by the lid member and in which the liquid can be collected, and the lid member includes a rotary handle on an outer circumferential edge portion on a front surface side, a rotation center shaft extending from a central portion on a back surface side to a bottom surface side of the cylindrical vessel, and a rotary arm member extending in a direction perpendicular to the rotation center shaft and holding the thin plate member fixing portion on a leading end side.

Moreover, in another form, the thin plate member fixing portion has a swing mechanism that swings during rotation in the liquid.

In another form of the thin plate member washing apparatus, the liquid flow generation means includes a pump mechanism that generates the liquid flow over the front surface and the back surface of the thin plate member by introducing a gas into the liquid in the washing vessel.

Moreover, in another form, the washing vessel includes the lid member and a cylindrical vessel having a top end opening that can be closed by the lid member and in which the liquid can be collected, the pump mechanism has a bellows pump main body that is disposed on the front surface side of the lid member and an ejection tube penetrating the lid member from the bellows pump main body and reaching a liquid surface position of the liquid collected inside the cylindrical vessel, and a region supporting the thin plate member fixing portion in a position under the ejection tube is provided inside the cylindrical vessel.

Moreover, in another form, a liquid flow reduction member is provided inside the cylindrical vessel, between the ejection tube and the thin plate member fixing portion.

Moreover, in another form, the thin plate member fixing portion is provided so as to be rotatable in accordance with the liquid flow from the ejection tube.

Advantageous Effects of Invention

With the thin plate member washing apparatus according to the present invention, it is possible to provide a thin plate member washing apparatus that can efficiently wash a thin plate member without causing damage to the thin plate member.

BRIEF DESCRIPTION OF DRAWINGS

FIG. 8(A) is a plan view, FIG. 8(B) is a cross-sectional view as viewed from arrows 8B-8B in FIG. 8(A) showing a stopped state, and FIG. 8(C) is a cross-sectional view as viewed from arrows 8B-8B in FIG. 8(A) showing a rotating state.

FIG. 9(A) is a plan view, FIG. 9(B) is a cross-sectional view as viewed from arrows 9B-9B in FIG. 9(A) showing a stopped state, and FIG. 9(C) is a cross-sectional view as viewed from arrows 9B-9B in FIG. 9(A) showing a rotating state.

DESCRIPTION OF EMBODIMENTS

Figure 1:
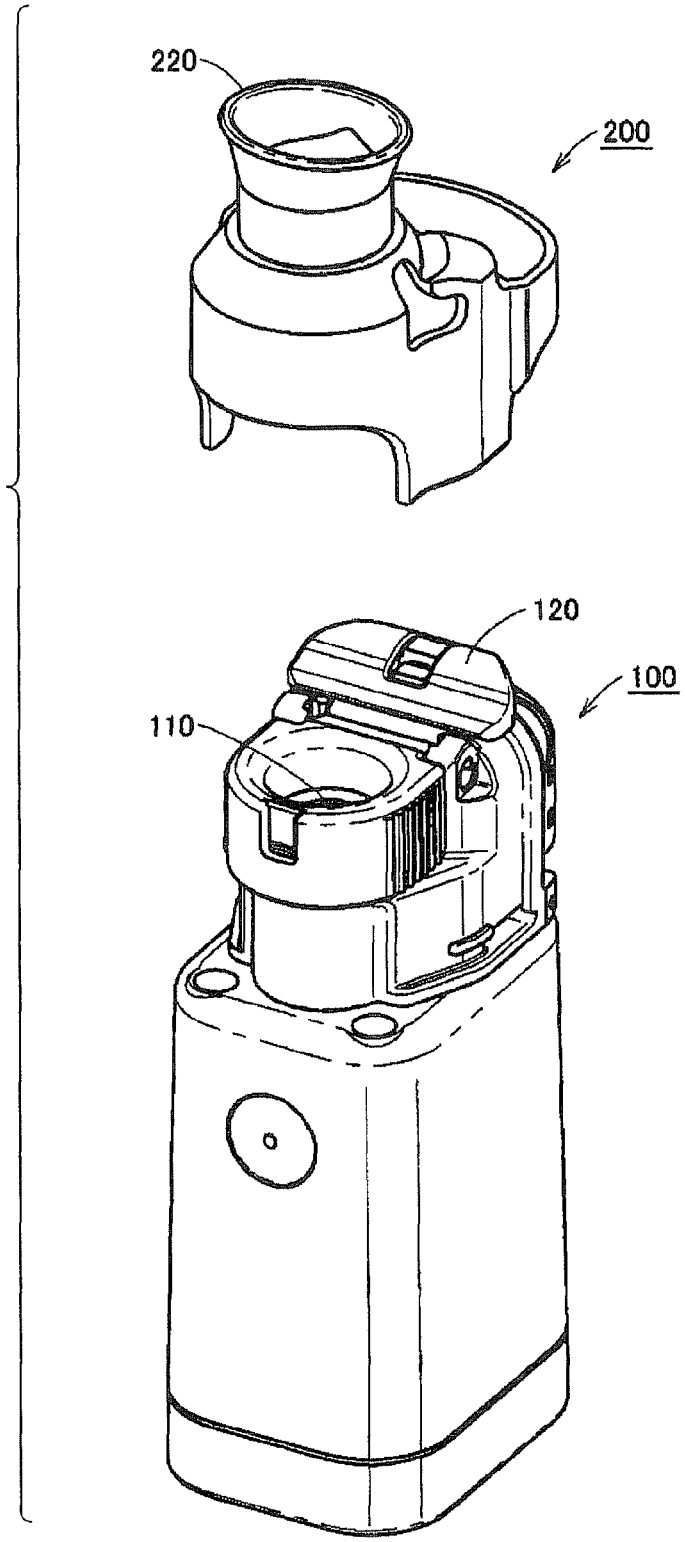
FIG. 1 is a first perspective view showing an overall configuration of a nebulizer including a mesh member.

Hereinafter, thin plate member washing apparatuses of embodiments according to the present invention will be described in detail with reference to the drawings. Note that in the case where a number, amount, or the like is mentioned in an embodiment described below, it is to be understood that the scope of the present invention is not necessarily limited to such a number, amount, or the like, unless otherwise stated. Moreover, in the case where a plurality of embodiments are described below, it is to be understood that it is planned to appropriately combine the individual embodiments, unless otherwise stated. The same reference numerals in the drawings indicate the same or corresponding portions, and redundant descriptions thereof may be omitted.

Moreover, although the case where tap water is used will be explained in descriptions of thin plate member washing apparatuses of embodiments below, a dedicated washing liquid can also be used.

Nebulizer Including Mesh Member

Figure 2:
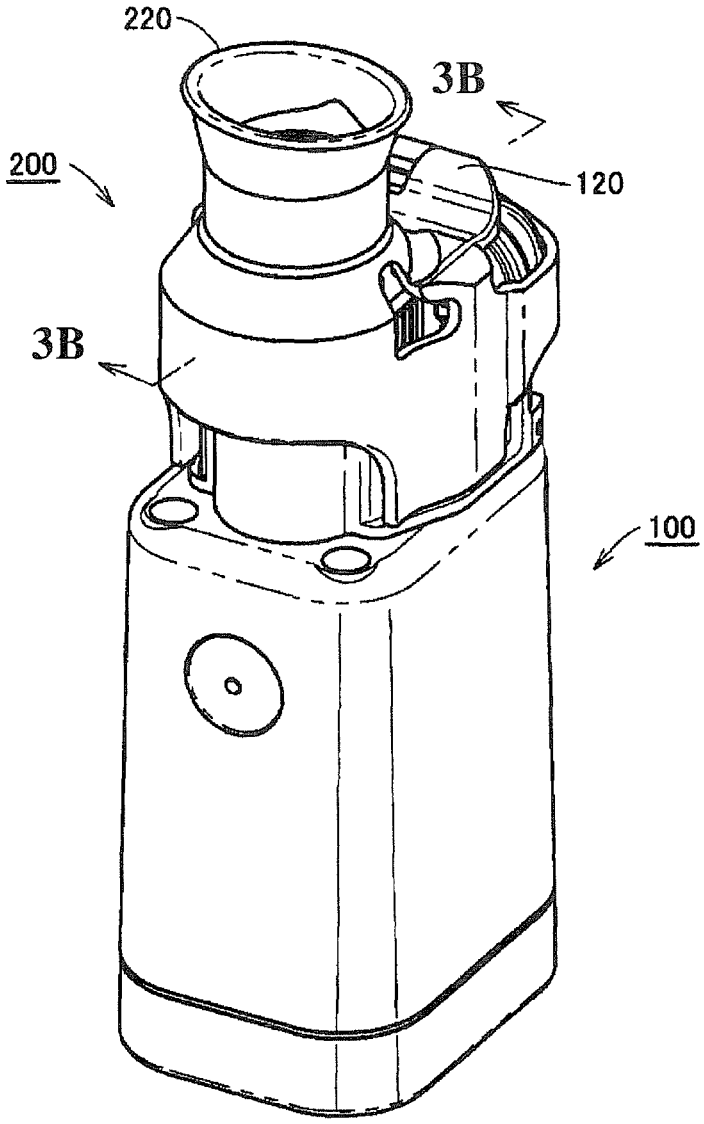
FIG. 2 is a second perspective view showing the overall configuration of the nebulizer including the mesh member.

A nebulizer including a mesh member serving as an example of a member to be washed will be described first with reference to FIGS. 1 to 3. Nebulizers are devices that are used mainly for medical purposes. An atomization portion of a nebulizer atomizes a medicinal fluid into a mist of particles, and the user inhales the mist of the medicinal fluid through his/her mouth or nose for treatment of a disease in the bronchus, nasal cavity, throat, or the like.

A nebulizer 100 shown in the drawings includes an ultrasonic mesh atomization mechanism. The nebulizer 100 includes a nozzle 110 for spraying the medicinal fluid on top of the atomization mechanism. Moreover, an open/close operation portion 120 for supplying the medicinal fluid into a medicinal fluid storage portion 130 (see FIG. 3) within the nebulizer 100 and facilitating washing of the medicinal fluid storage portion 130 is provided in an upper portion of the nebulizer 100. The medicinal fluid can also be supplied by opening and closing the nozzle 110.

A mouthpiece 200 serving as an inhalation aid for the nebulizer 100 is integrally formed from a resin material. The mouthpiece 200 has a shape that enables attachment to the top of the nebulizer 100, and includes a tubular portion 240 (see FIG. 3) inside, through which the mist of the medicinal fluid sprayed from the nozzle 110 of the nebulizer 100 passes.

An inhalation port 220 serving as a second opening to be held in the user's mouth is provided in an upper surface of the mouthpiece 200. The tubular portion 240 of the mouthpiece 200 has an air intake 230 serving as a third opening for taking in air at a predetermined position, rather than being attached to the nozzle 110 of the nebulizer 100 in an airtight manner.

The user uses the nebulizer 100 held in his/her hand in a state in which the mouthpiece 200 is attached to the top of the nebulizer 100. At this time, the user slightly tilts the nebulizer 100 toward him/her and holds the inhalation port 220 of the mouthpiece 200 in his/her mouth.

Figure 3A:
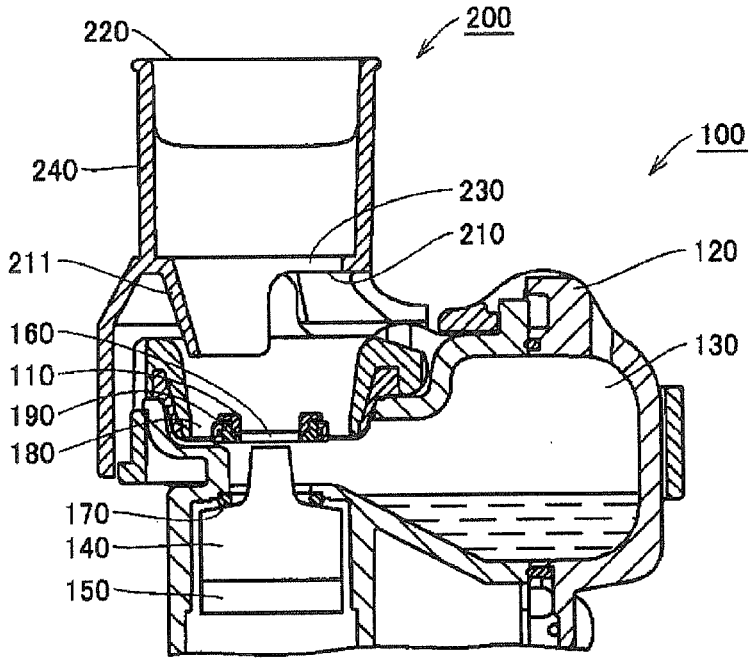
FIGS. 3(A) and 3(B) are partial cross-sectional views as viewed from arrows 3B-3B in FIG. 2.
Figure 3B:
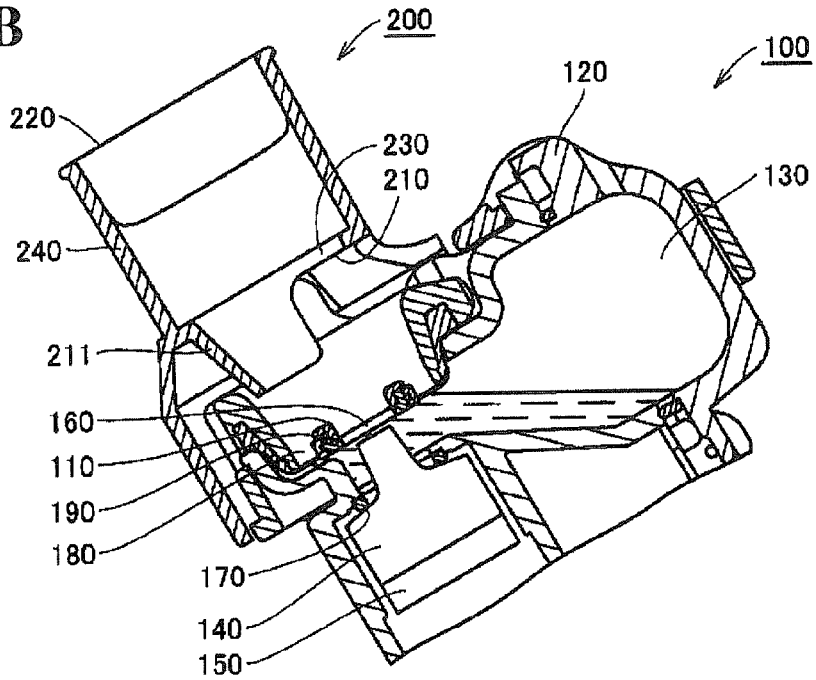

Next, the structure of the nebulizer 100 and the shape of the mouthpiece 200 will be described in further detail with reference to FIGS. 3(A) and 3(B). FIG. 3(A) shows a state in which the nebulizer 100 is kept in a horizontal position, and FIG. 3(B) shows a state in which the user has tilted the nebulizer 100 toward him/her to use the nebulizer 100.

The nebulizer 100 includes the ultrasonic mesh atomization mechanism immediately under the nozzle 110. The ultrasonic mesh atomization mechanism is composed of a piezoelectric element 150, a stepped horn 140, and a mesh member 160. The mesh member 160 has a metal thin plate member in which multiple minute holes are formed and a resin member provided around the thin plate member. A lower surface of the mesh member 160 is in contact with an end of the stepped horn 140. The mesh member 160 is detachably attached to a partition plate 190 so as to enable the user to detach it for washing.

The piezoelectric element 150 starts vibrating when driven by a power supply. The vibration propagates to the stepped horn 140, causing the medicinal fluid to be atomized at a contact surface between the stepped horn 140 and the mesh member 160. The atomized medicinal fluid is ejected from the minute holes toward the nozzle 110 of the nebulizer 100 with great force.

A fluid collecting portion 180 for storing the medicinal fluid that has deposited on the tubular portion 240 and hence become liquid droplets and saliva that runs from the user's mouth is formed along a peripheral edge of the nozzle 110. The medicinal fluid and the saliva stored in the fluid collecting portion 180 are isolated by the partition plate 190 so as not to enter the mesh member 160 located on the inside of the fluid collecting portion 180.

The medicinal fluid storage portion 130 adjoining to the atomization portion is formed inside the nebulizer 100. The medicinal fluid is replenished by opening and closing the aforementioned nozzle 110. As a result of the nebulizer 100 being tilted during use, all of the medicinal fluid stored in the medicinal fluid storage portion 130 is supplied to the atomization portion and atomized. For this reason, the atomization portion has a watertight structure with an O-ring 170 in order to prevent the medicinal fluid from dripping into the apparatus.

As described above, the mouthpiece 200 includes the tubular portion 240 through which the atomized medicinal fluid passes and includes, at opposite ends of the tubular portion 240, an atomizer-side opening 210 serving as a first opening that faces the nozzle 110 of the nebulizer 100 in a state in which the mouthpiece 200 is attached to the nebulizer 100 and the inhalation port 220 serving as the second opening to be held in the user's mouth.

A flange portion 211 contiguous with the tubular portion 240 is provided in a portion of the peripheral edge of the atomizer-side opening 210. The flange portion 211 has a function of collecting and guiding the medicinal fluid that has become liquid droplets and the saliva into the fluid collecting portion 180 of the nebulizer 100 so as to prevent dripping of such liquid.

The flange portion 211 is not provided along the entire peripheral edge of the opening lest the tubular portion 240 is made airtight, but rather the air intake 230 for taking in air is formed in a portion of the peripheral edge of the atomizer-side opening where the flange portion is not formed. The air intake 230 is formed by cutting the atomizer-side opening. Thus, airflow is constantly generated in the tubular portion 240.

Embodiment 1

Figure 4:
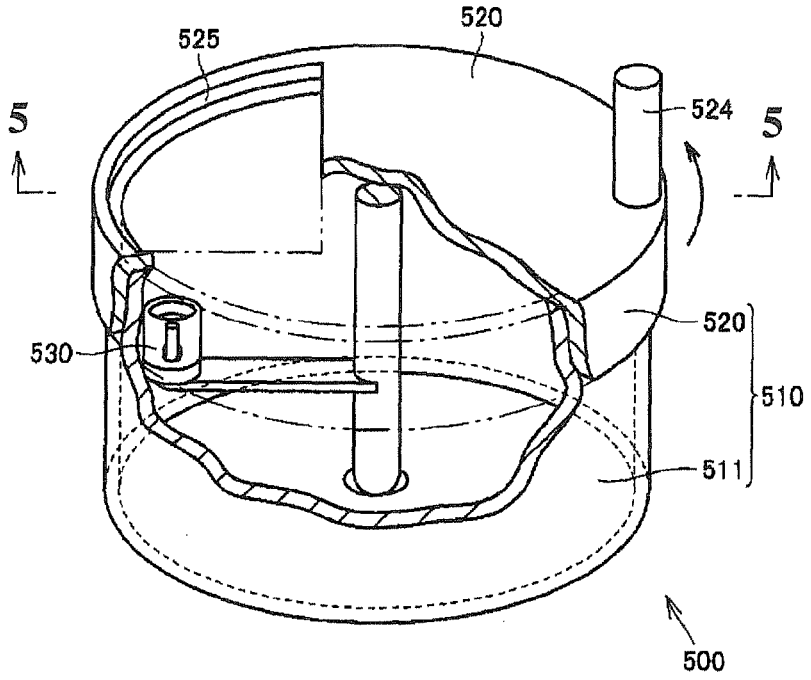
FIG. 4 shows an external configuration of a thin plate member washing apparatus of Embodiment 1.
Figure 6:
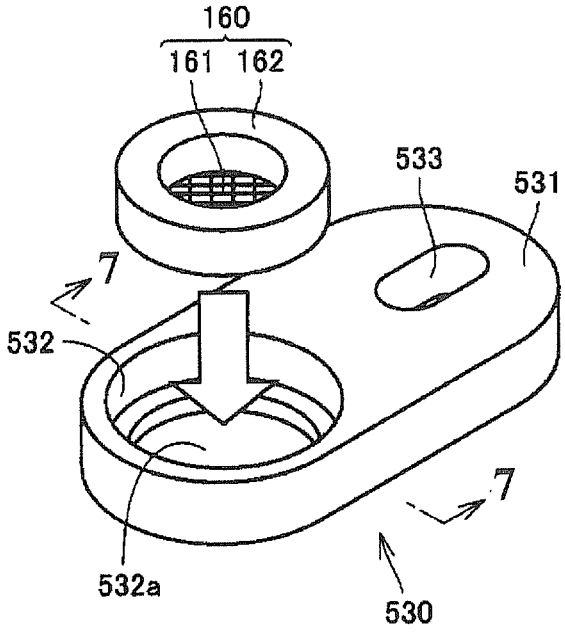
FIG. 6 is a perspective view showing a specific configuration of a mesh member holding portion that is employed in the thin plate member washing apparatus of Embodiment 1.
Figure 7:
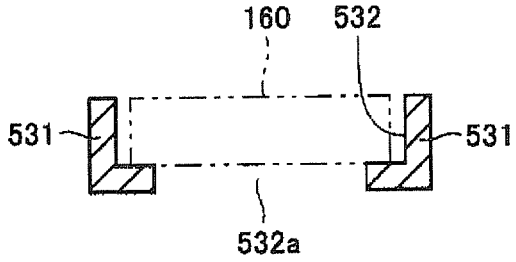
FIG. 7 is a partial cross-sectional view as viewed from arrows 7-7 in FIG. 6.

Next, the structure of a thin plate member washing apparatus 500 of Embodiment 1 according to the present invention will be described with reference to FIGS. 4 to 8. FIG. 4 shows an external configuration of the thin plate member washing apparatus 500, FIG. 5 is a partial cross-sectional view as viewed from arrows 5-5 in FIG. 4, FIG. 6 is a perspective view showing a specific configuration of a mesh member holding portion 530 that is employed in the thin plate member washing apparatus 500, FIG. 7 is a partial cross-sectional view as viewed from arrows 7-7 in FIG. 6, and FIGS. 8(A) to 8(C) are enlarged views showing a state in which the mesh member holding portion 530 that is employed in the thin plate member washing apparatus 500 is supported.

Thin Plate Member Washing Apparatus 500

Figure 5:
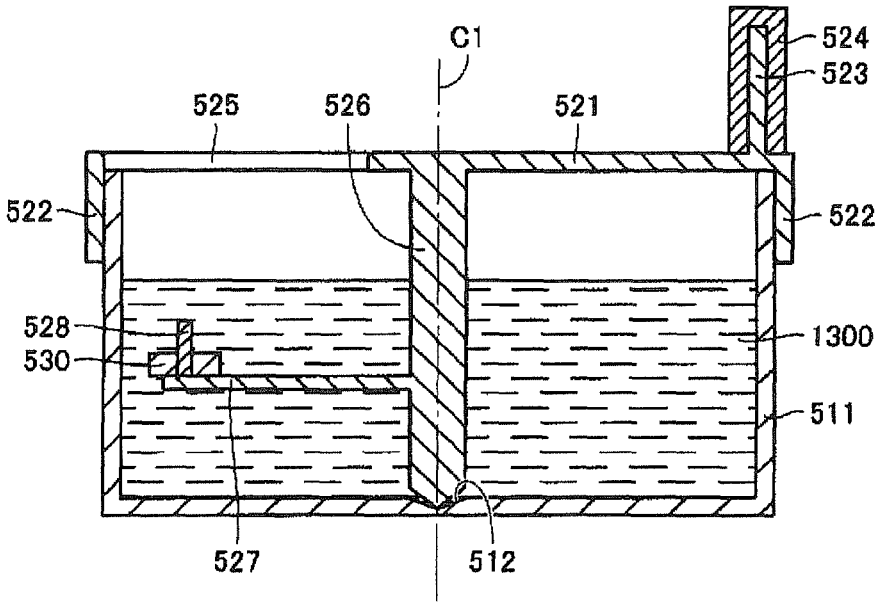
FIG. 5 is a partial cross-sectional view as viewed from arrows 5-5 in FIG. 4.

First, referring to FIGS. 4 and 5, the thin plate member washing apparatus 500 has a washing vessel 510 in which tap water 1300 can be collected. The washing vessel 510 has a circular lid member 520 and a cylindrical vessel 511 having a top opening that can be closed by the lid member 520 and in which the tap water 1300 can be collected. The lid member 520 has a circular top panel portion 521 and a cylindrical edge portion 522 that covers the side of an upper end portion of the cylindrical vessel 511 along the entire circumference of the edge of the top panel portion 521.

A pin 523 is vertically disposed on an outer circumferential edge, on a front surface side, of the top panel portion 521 of the lid member 520, and a rotary handle 524 is rotatably fitted to the pin 523. Moreover, an opening 525 for inserting and removing the mesh member holding portion 530 that can hold a mesh member 160, which will be described later, is provided in the top panel portion 521.

A rotation center shaft 526 extending from a central portion, on a back surface side, of the top panel portion 521 of the lid member 520 to a bottom surface side of the cylindrical vessel 511 is provided. The rotation center shaft 526 is provided with a rotary arm member 527 extending in a direction perpendicular to the rotation center shaft 526 and supporting the mesh member holding portion 530 on a leading end side.

An engagement pin 528 extends upward from a leading end region of the rotary arm member 527, and the engagement pin 528 is used to support the mesh member holding portion 530. A shaft receiving recess 512 that receives a leading end of the rotation center shaft 526 is provided in the bottom surface of the cylindrical vessel 511.

The lid member 520 is rotated about the rotation center shaft 526 serving as an axis of rotation (C1) by putting the lid member 520 on the cylindrical vessel 511 having the above-described configuration, grasping the rotary handle 524, and rotating the lid member 520. The rotary arm member 527 is rotated accordingly. Therefore, in the washing vessel 510, the rotary handle 524, the rotation center shaft 526, and the rotary arm member 527 constitute a main rotation mechanism that rotates the mesh member holding portion 530 around the rotation center shaft (C1).

Next, the configuration of the mesh member holding portion 530 that can hold the mesh member 160 will be described with reference to FIGS. 6 and 7. The mesh member 160 is composed of a metal thin plate member 161 in which multiple minute holes are formed and an annular resin member 162 integrally provided around the thin plate member 161. The mesh member holding portion 530 is provided with an approximately elliptic main body portion 531, an accommodating recess 532 that receives the mesh member 160 on one end side of the main body portion 531, and an engagement hole 533 in which the engagement pin 528 provided on the rotary arm member 527 can be inserted. A through hole 532*a* is provided in the accommodating recess 532. The engagement hole 533 is an elongated hole that is formed in a longitudinal direction of the main body portion 531.

Washing of Mesh Member 160

Figure 8A:
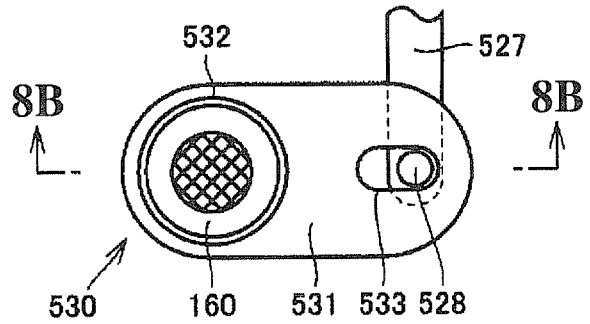
FIGS. 8(A) to 8(C) are enlarged views showing a state in which the mesh member holding portion that is employed in the thin plate member washing apparatus of Embodiment 1 is supported.
Figure 8B:
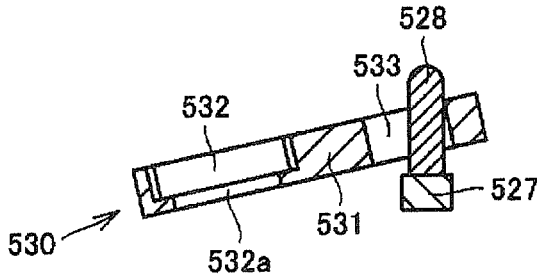

Next, washing of the mesh member 160 using the thin plate member washing apparatus 500 will be described with reference to FIGS. 8(A), 8(B), and 8(C). A defined amount of tap water 1300 is collected in the washing vessel 500, and the mesh member holding portion 530 is engaged with the engagement pin 528 of the rotary arm member 527, as shown in FIG. 8(A). As shown in FIG. 8(B), in the case where the rotary arm member 527 is not rotating, the mesh member holding portion 530 is in a state in which it hangs down from the engagement pin 528.

Figure 8C:
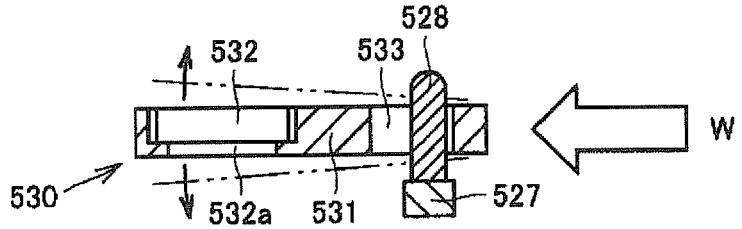

Then, as shown in FIG. 8(C), in a state in which the rotary arm member 527 is rotating, the mesh member holding portion 530 is in a state in which it is rotated in an approximately horizontal position due to the resistance of a liquid flow (W) and subjected to the liquid flow for washing the surface of the mesh member 160. The tap water 1300 flows over the surface of the mesh member 160, and medicinal fluid residue and the like deposited on the mesh member 160 are removed.

Effects

As described above, when the mesh member 160 is washed using the thin plate member washing apparatus 500 of the present embodiment, the mesh member 160 can be easily washed by rotating the rotary arm member 527 supporting the mesh member holding portion 530. Moreover, quantitative and more uniform washing can be achieved by predetermining the rotational frequency.

Moreover, the mesh member holding portion 530 swings vertically based on a change in the rotational speed of the rotary arm member 527 and a change in flow velocity of the tap water flowing on the front surface side and the back surface side of the mesh member 160. This swinging motion can also enhance the mesh member 160 washing effect.

Moreover, water with great force does not strike the mesh member 160 and therefore cannot damage the mesh member 160, especially the metal thin plate member 161. Moreover, the mesh member 160 is accommodated inside the thin plate member washing apparatus 500 and therefore cannot be lost.

As described above, with the thin plate member washing apparatus 500 of the present embodiment, it is possible to efficiently wash a mesh member 160 without causing damage to the mesh member 160.

Embodiment 2

Next, the structure of a thin plate member washing apparatus of Embodiment 2 according to the present invention will be described with reference to FIGS. 9(A), 9(B), and 9(C). The thin plate member washing apparatus of Embodiment 2 has the same basic configuration as the above-described thin plate member washing apparatus 500 of Embodiment 1. The difference is only the form of a mesh member holding portion 530A.

For this reason, in the drawings, the same components are denoted by the same reference numerals and duplication is eliminated, and only the mesh member holding portion 530A of the present embodiment will be described.

Mesh Member Holding Portion 530A

Figure 9A:
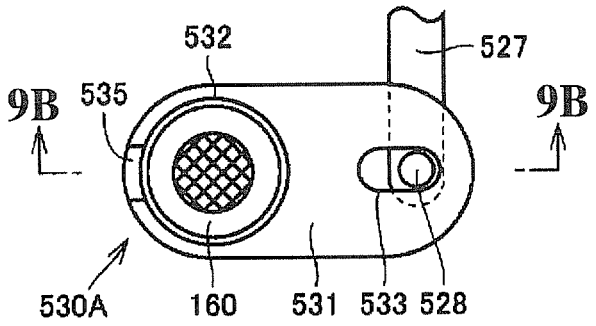
FIGS. 9(A) to 9(C) are enlarged views showing a state in which a mesh member holding portion that is employed in a thin plate member washing apparatus of Embodiment 2 is supported.
Figure 9B:
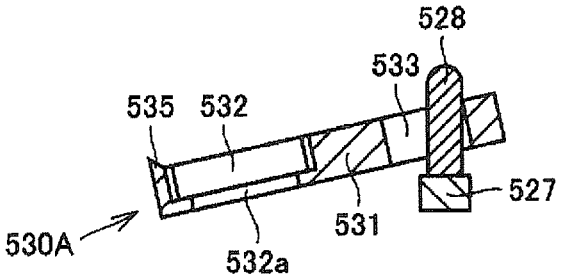

As shown in FIGS. 9(A) and 9(B), the mesh member holding portion 530A of this embodiment has the same basic configuration as the mesh member holding portion 530 of Embodiment 1, and the difference is that a swing protrusion 535 having a triangular cross-sectional shape is disposed on a leading end side portion of the main body portion 531 on the side on which the accommodating recess 532 is provided.

Effects

Figure 9C:
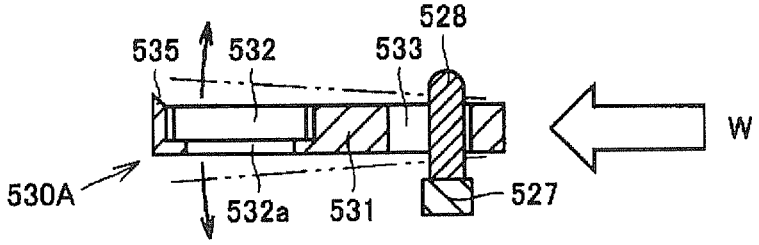

Also in the thin plate member washing apparatus that uses the thus configured mesh member holding portion 530A, as shown in FIG. 9(C), in a state in which the rotary arm member 527 is rotating, the mesh member holding portion 530A is in a state in which it is rotated in an approximately horizontal position due to the resistance of the liquid flow and subjected to the liquid flow for washing the surface of the mesh member 160. The tap water 1300 flows over the surface of the mesh member 160 and medicinal fluid residue and the like deposited on the mesh member 160 are removed, and the same effects as those of Embodiment 1 can be obtained.

Furthermore, in addition to the change in the rotational speed of the rotary arm member 527 and the change in the flow velocity of tap water flowing on the front surface side and the back surface side of the mesh member 160, the swing protrusion 535 provided on the main body portion 531 can positively swing the mesh member holding portion 530A vertically, and the mesh member 160 washing effect can be enhanced even more.

Embodiment 3

Next, the structure of a thin plate member washing apparatus of Embodiment 3 according to the present invention will be described with reference to FIGS. 10 and 11. The thin plate member washing apparatus of Embodiment 3 has the same basic configuration as the above-described thin plate member washing apparatus 500 of Embodiment 1. The difference is only the form of a mesh member holding portion 530B.

For this reason, in the drawings, the same components are denoted by the same reference numerals and duplication is eliminated, and only the mesh member holding portion 530B of the present embodiment will be described.

Mesh Member Holding Portion 530B

Figure 10:
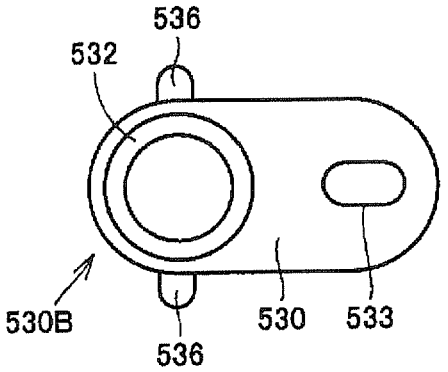
FIG. 10 is a plan view of a mesh member holding portion that is employed in a thin plate member washing apparatus of Embodiment 3.

As shown in FIG. 10, the mesh member holding portion 530B of this embodiment has the same basic configuration as the mesh member holding portion 530 of Embodiment 1, and the difference is that elastic members 536 are provided on side surface portions of the main body portion 531 on the side on which the accommodating recess 532 is provided.

Effects

Figure 11:
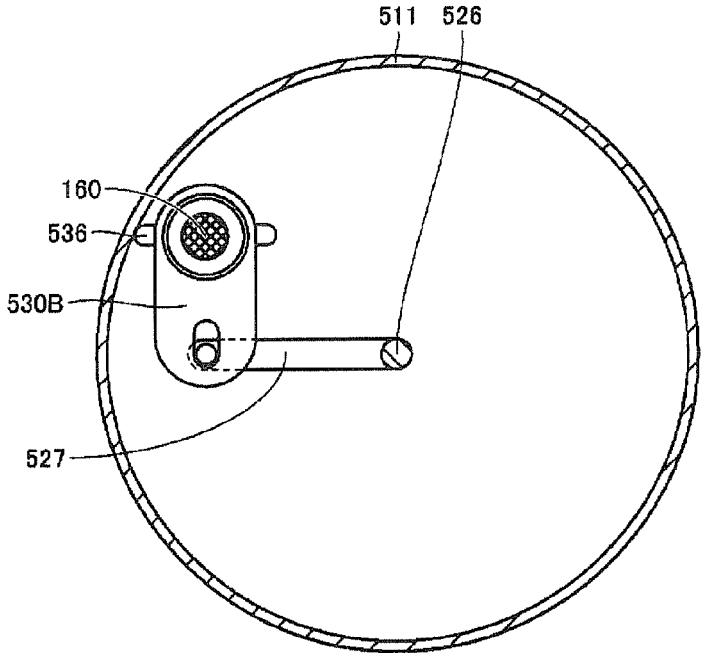
FIG. 11 is a plan view showing a state in which the mesh member holding portion that is employed in the thin plate member washing apparatus of Embodiment 3 is supported.

Also in the thin plate member washing apparatus that uses the mesh member holding portion 530B having the above-described configuration, as shown in FIG. 11, in a state in which the rotary arm member 527 is rotating, the mesh member holding portion 530B is rotated in an approximately horizontal position due to the resistance of the liquid flow and subjected to the liquid flow for washing the surface of the mesh member 160. The tap water 1300 flows over the surface of the mesh member 160 and medicinal fluid residue and the like deposited on the mesh member 160 are removed, and the same effects as those of Embodiment 1 can be obtained.

Furthermore, the elastic members 536 provided on the main body portion 531 cause a centrifugal force to act on the mesh member holding portion 530B and reduce the noise and impact when the mesh member holding portion 530B collides with an inner surface of the cylindrical vessel 511, and urge the mesh member holding portion 530 to swing horizontally in addition to swinging vertically, and therefore, the mesh member 160 washing effect can be enhanced even more. Note that although the case where the elastic members 536 are provided on the side surface portions on opposite sides is shown in the drawings, a configuration in which an elastic member 536 is provided on only one side can also be employed.

Embodiment 4

Figure 12:
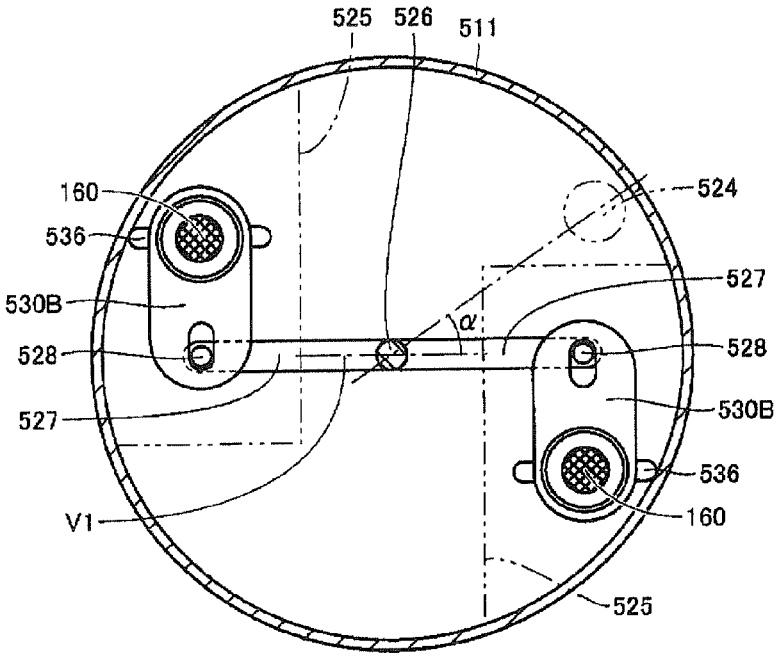
FIG. 12 is a plan view showing the configuration of a thin plate member washing apparatus of Embodiment 4.

Next, the structure of a thin plate member washing apparatus of Embodiment 4 according to the present invention will be described with reference to FIG. 12. The thin plate member washing apparatus of Embodiment 4 has the same basic configuration as the above-described thin plate member washing apparatus of Embodiment 3. The difference is that mesh member holding portions 530B are provided in two positions. Therefore, in the drawings, the same components are denoted by the same reference numerals, and duplication is eliminated.

The rotary arm member 527 of the present embodiment is provided so as to extend linearly on opposite sides of the rotation center shaft 526, and engagement pins 528 are respectively provided on opposite end portions of the rotary arm member 527. Note that in the present embodiment, the rotary handle 524 is provided in a position offset from an axis (V1) of the rotary arm member 527 by an angle of a degrees.

Effects

Also in the thin plate member washing apparatus in which the mesh member holding portions 530B having the above-described configuration are provided in two positions, the same effects as those of Embodiment 3 can be obtained. Note that a configuration in which mesh member holding portions are provided in two or more positions can also be applied to the thin plate member washing apparatuses of Embodiments 1 to 3 and thin plate member washing apparatuses of embodiments that will be described later.

Embodiment 5

Next, the structure of a thin plate member washing apparatus of Embodiment 5 according to the present invention will be described with reference to FIG. 13. The thin plate member washing apparatus of Embodiment 5 has the same basic configuration as the above-described thin plate member washing apparatus 500 of Embodiment 1. The difference is the manner in which a mesh member holding portion 530C is attached to the rotary arm member 527.

Therefore, in the drawings, the same components are denoted by the same reference numerals and duplication is eliminated, and only the manner in which the mesh member holding portion 530C is attached to the rotary arm member 527 of the present embodiment will be described.

Mesh Member Holding Portion 530C

Figure 13:
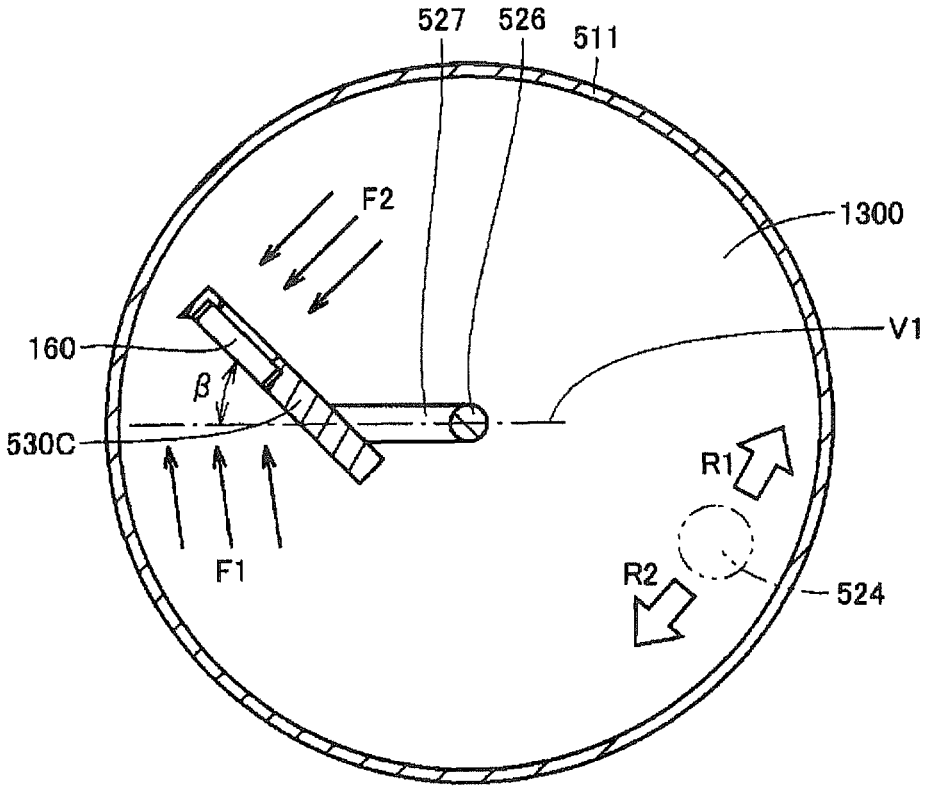
FIG. 13 is a plan view showing the configuration of a thin plate member washing apparatus of Embodiment 5.

As shown in FIG. 13, the mesh member holding portion 530C of this embodiment has the same configuration as the mesh member holding portion 530 of Embodiment 1, and the difference is that the mesh member holding portion 530C is fixed to the rotary arm member 527 in such a manner that the mesh member 160 is in a vertical position. Moreover, the mesh member holding portion 530C is fixed to the rotary arm member 527 in such a manner that the axis (V1) of the rotary arm member 527 and the surface of the mesh member holding portion 530C intersect at an intersection angle of (β) degrees.

Washing of Mesh Member 160

Washing of the mesh member 160 using the thin plate member washing apparatus of the present embodiment will be described. As shown in FIG. 13, the rotary handle 524 is rotated in the direction of arrow R1 (the counterclockwise direction in the drawing) with the tap water 1300 collected in the cylindrical vessel 511. Thus, the surface of the mesh member 160 is subjected to a liquid flow flowing in the direction of arrow F1. The tap water 1300 flows over the surface of the mesh member 160, and medicinal fluid residue and the like deposited on the mesh member 160 are removed.

Next, in the present embodiment, the tap water 1300 is drained from the cylindrical vessel 511, and the rotary handle 524 is rotated in the direction of arrow R2 (the clockwise direction in the drawing). Thus, the surface of the mesh member 160 is subjected to a flow of air flowing in the direction of arrow F2. The air flows over the surface of the mesh member 160 and can dry the surface of the mesh member 160 (centrifugal force dehydration).

As a result of setting the intersection angle (β) between the axis (V1) of the rotary arm member 527 and the surface of the mesh member holding portion 530C to about 30 degrees, the tap water 1300 does not perpendicularly strike the mesh member 160 during washing and therefore cannot damage the mesh member 160. Moreover, during drying, air perpendicularly strikes the mesh member 160, and therefore, the drying speed can be increased.

Effects

As described above, also when the mesh member 160 is washed using the thin plate member washing apparatus of the present embodiment, the mesh member 160 can be easily washed by rotating the rotary arm member 527 supporting the mesh member holding portion 530C. Moreover, quantitative and more uniform washing can be achieved by predetermining the rotational frequency, and the same effects as those of Embodiment 1 above can be obtained. Furthermore, according to the present embodiment, the mesh member 160 after washing can be dried by draining the tap water 1300 and then rotating the mesh member 160.

As described above, with the thin plate member washing apparatus of the present embodiment, it is possible to efficiently wash a mesh member 160 without causing damage to the mesh member 160.

Note that although the case where the intersection angle (β) between the axis (V1) of the rotary arm member 527 and the surface of the mesh member holding portion 530C is set to about 30 degrees has been described as a preferred example in the above-described embodiment, the intersection angle is not limited to 30 degrees, and an optimum tilt angle is selected in accordance with the size of the thin plate member washing apparatus 500 and the size of the mesh member 160. Moreover, favorable washing properties and drying properties can also be obtained by setting the tilt angle to 0 degrees (a linear state).

Moreover, it is also possible to use the rotation in the R2 direction for washing and the rotation in the R1 direction for drying.

Embodiment 6

Next, the structure of a thin plate member washing apparatus of Embodiment 6 according to the present invention will be described with reference to FIG. 14. The thin plate member washing apparatus of Embodiment 6 has the same basic configuration as the above-described thin plate member washing apparatus 500 of Embodiment 1. The difference is that a vertical wall 513 that collects the medicinal fluid residue and the like is provided in the cylindrical vessel 511.

Figure 14:
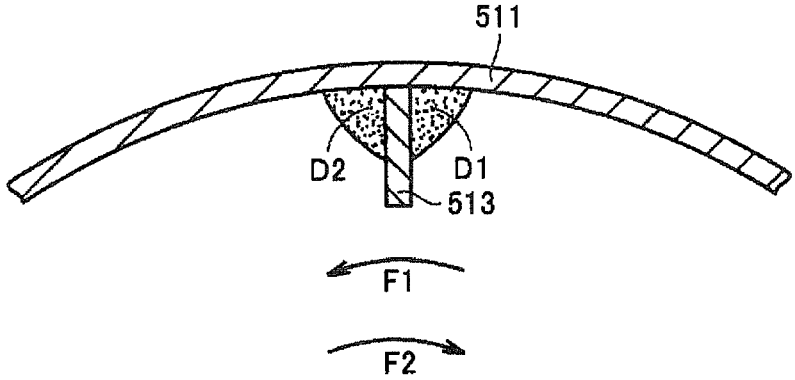
FIG. 14 is a partial enlarged cross-sectional view showing the configuration of a thin plate member washing apparatus of Embodiment 6.

As shown in FIG. 14, the vertical wall 513 extending toward the center is provided in the cylindrical vessel 511 of the thin plate member washing apparatus of the present embodiment. Since the vertical wall 513 is provided, when the tap water is rotating in the F1 direction, the medicinal fluid residue and the like flow outward due to the centrifugal force and are collected on a side surface of the vertical wall 513 as the medicinal fluid residue and the like D1. Conversely, when the tap water is rotating in the F2 direction, the medicinal fluid residue and the like flow outward due to the centrifugal force and are collected on a side surface of the vertical wall 513 as the medicinal fluid residue and the like D2.

Note that the position in which the vertical wall 513 is provided, the length in the center direction, the length in the axial direction, the number, the amount, and the like are appropriately chosen based on the capacity and the like of the cylindrical vessel 511.

Effects

As described above, also when the mesh member 160 is washed using the thin plate member washing apparatus of the present embodiment, the mesh member 160 can be easily washed by rotating the rotary arm member 527 supporting the mesh member holding portion 530. Moreover, quantitative and more uniform washing can be achieved by predetermining the rotational frequency, and the same effects as in the case of Embodiment 1 above can be obtained. Furthermore, according to the present embodiment, since the medicinal fluid residue and the like in the tap water 1300 are collected on the side surface of the vertical wall 513, redeposition of the medicinal fluid residue and the like onto the mesh member 160 can be suppressed.

As described above, with the thin plate member washing apparatus of the present embodiment, it is possible to efficiently wash a mesh member 160 without causing damage to the mesh member 160.

Note that although the cases where the mesh member holding portion 530, 530A, 530B, or 530C is used to enable the rotary arm member 527 to support the mesh member 160 have been described in Embodiments 1 to 6 above, an engagement region for enabling the rotary arm member 527 to support the mesh member 160 can also be provided in the mesh member 160 itself, which is to be mounted to a nebulizer.

Moreover, although a configuration in which the rotary handle 524 provided on the lid member 520 is used to rotate the mesh member 160 is employed in Embodiments 1 to 6 above, a configuration in which the mesh member 160 is fixed to the cylindrical vessel 511 side and a liquid flow of the tap water 1300 over the surface of the mesh member 160 is generated by rotating the rotary arm member 527 can also be employed.

Embodiment 7

Figure 15:
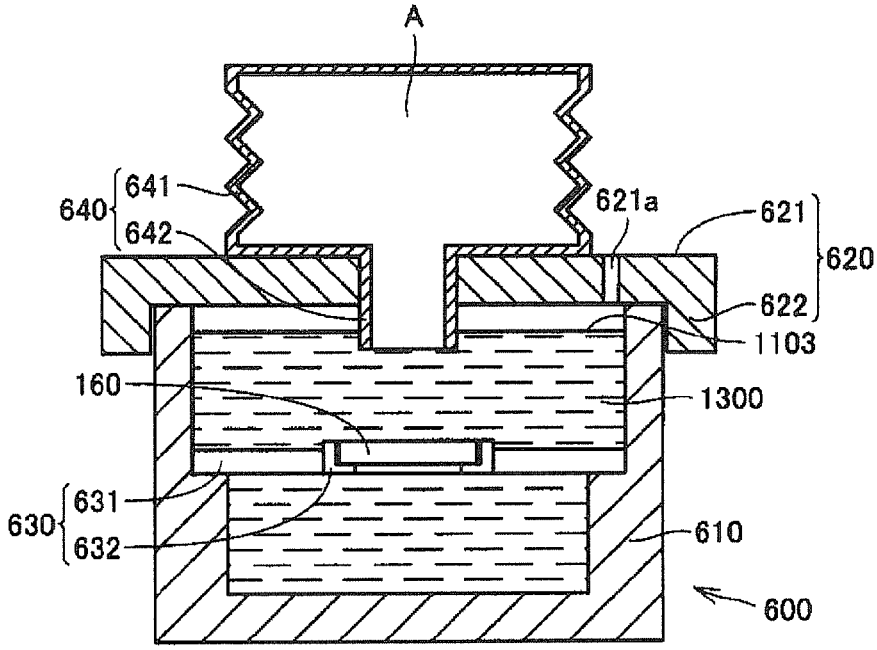
FIG. 15 is a first vertical cross-sectional view showing the configuration of a thin plate member washing apparatus of Embodiment 7.
Figure 16:
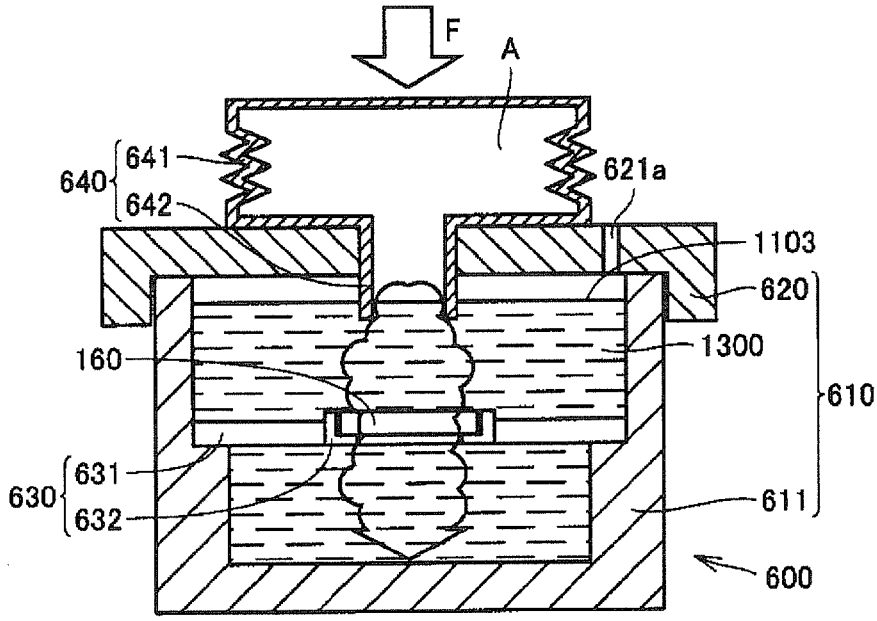
FIG. 16 is a second vertical cross-sectional view showing the configuration of the thin plate member washing apparatus of Embodiment 7.

Next, the structure of a thin plate member washing apparatus 600 of Embodiment 7 according to the present invention will be described with reference to FIGS. 15 and 16. FIG. 15 is a first vertical cross-sectional view showing the configuration of the thin plate member washing apparatus 600, and FIG. 16 is a second vertical cross-sectional view showing the configuration of the thin plate member washing apparatus 600.

Thin Plate Member Washing Apparatus 600

First, referring to FIG. 15, the thin plate member washing apparatus 600 has a washing vessel 610 in which tap water 1300 can be collected. The washing vessel 610 includes a circular lid member 620 and a cylindrical vessel 611 having a top end opening that can be closed by the lid member 620 and in which the tap water 1300 can be collected. The lid member 620 has a circular top panel portion 621 and a cylindrical edge portion 622 that covers the side of an upper end portion of the cylindrical vessel 611 along the entire circumference of the edge of the top panel portion 621. An air hole 621*a* is provided in the top panel portion 621.

A pump mechanism 640 is provided in a central portion, on the front surface side, of the top panel portion 621 of the lid member 620. The pump mechanism 640 has a bellows pump main body 641 disposed on the front surface side of the top panel portion 621 of the lid member 620 and an ejection tube 642 that penetrates the top panel portion 621 from the bellows pump main body 641 and reaches a liquid surface position of the tap water 1300 collected in the cylindrical vessel 611. The bellows pump main body 641 is provided with a check valve, which is omitted from the drawings, so that only outside air (A) can be taken in.

A mesh member holding portion 630 that supports a mesh member 160 in a position under the ejection tube 642 is provided inside the cylindrical vessel 611. The mesh member holding portion 630 has an arm portion 631 and a holding portion 632, and the arm portion 631 is fixedly supported by an inner circumferential surface of the cylindrical vessel 611. The holding portion 632 holds the mesh member 160 in a horizontal position. Moreover, a liquid surface line 1103 is engraved or printed on a side wall portion in an upper end region of the cylindrical vessel 610 as a mark indicating a level to which tap water needs to be collected in the cylindrical vessel 610.

Washing of Mesh Member 160

Next, washing of the mesh member 160 using the thin plate member washing apparatus 600 will be described with reference to FIGS. 15 to 17. As shown in FIG. 15, a defined amount of tap water 1300 is collected in the washing vessel 600, and the mesh member 160 is mounted to the mesh member holding portion 630. A leading end portion of the ejection tube 642 of the pump mechanism 640 is immersed under the liquid surface of the tap water 1300. Therefore, an air layer (A) and a liquid layer (1300) are present in the ejection tube 642.

Next, as shown in FIG. 16, the bellows pump main body 641 is pressed in (the direction of arrow F in the drawing). This causes only the air in the bellows pump main body 641 to be forced out into the cylindrical vessel 611. The air (bubbles) that has been forced out generates a liquid flow, which makes contact with the mesh member 160 and washes a surface of the mesh member 160.

Figure 17:
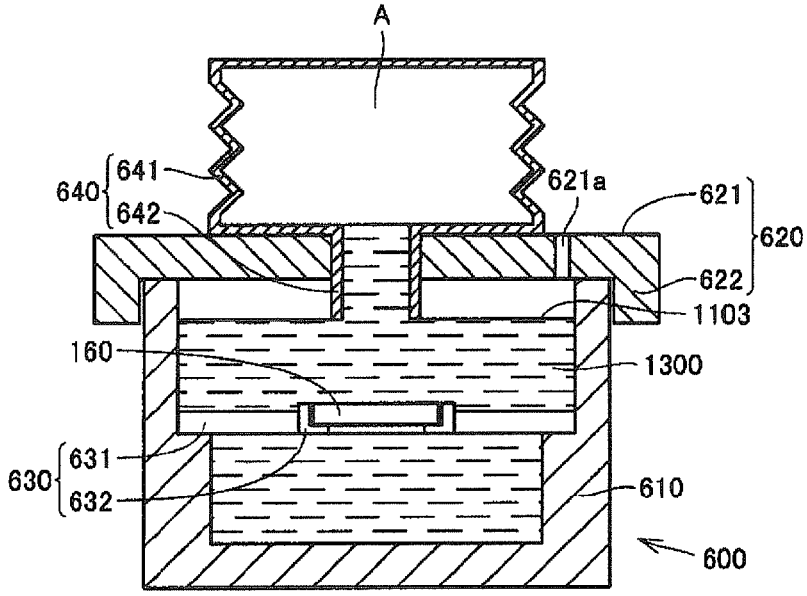
FIG. 17 is a third vertical cross-sectional view showing the configuration of the thin plate member washing apparatus of Embodiment 7.

Next, as shown in FIG. 17, the bellows pump main body 641 is restored to its natural state. At this time, the tap water 1300 in the cylindrical vessel 611 is pumped up into the bellows pump main body 641 so that the inside of the ejection tube 642 is filled with the water. Then, when the bellows pump main body 641 is pressed in, the tap water 1300 in the ejection tube 642 is ejected and generates a liquid flow, which makes contact with the mesh member 160 and washes the surface of the mesh member 160 (first washing effect). Furthermore, as a result of the bellows pump main body 641 being pressed in, air in the bellows pump main body 641 is forced out into the cylindrical vessel 611. The air (bubbles) that has been forced out generates a liquid flow, which makes contact with the mesh member 160 and washes the surface of the mesh member 160 (second washing effect).

Repetition of this operation causes the tap water 1300 containing air (bubbles) to flow over the surface of the mesh member 160, and therefore, the medicinal fluid residue and the like deposited on the mesh member 160 are removed. Then, the mesh member holding portion 630 is rotated 180 degrees, and a surface of the mesh member 160 on the other side is washed in the same manner. Note that checking of the surface to be washed of the mesh member 160 can be facilitated by making the color of the surface on one side and the color of the surface on the other side of the mesh member holding portion 630 different from each other.

Effects

As described above, when the mesh member 160 is washed using the thin plate member washing apparatus 600 of the present embodiment, the first washing by only the liquid flow of the tap water 1300 and thereafter the second washing by the liquid flow containing a lot of air bubbles are performed because the pump mechanism 640 is used, and therefore, the mesh member 160 can be easily washed. Moreover, quantitative and more uniform washing can be achieved by predetermining the number of times the pump mechanism 640 is pressed.

As described above, with the thin plate member washing apparatus 600 of the present embodiment, it is possible to efficiently wash a mesh member 160 without causing damage to the mesh member 160.

Embodiment 8

Figure 18:
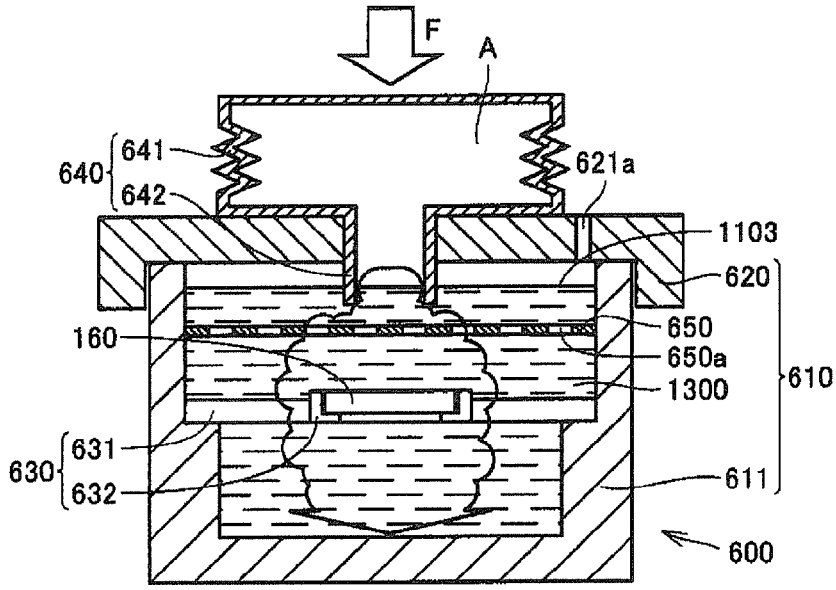
FIG. 18 is a vertical cross-sectional view showing the configuration of a thin plate member washing apparatus of Embodiment 8.

Next, the structure of a thin plate member washing apparatus of Embodiment 8 according to the present invention will be described with reference to FIG. 18. The thin plate member washing apparatus of Embodiment 8 has the same basic configuration as the above-described thin plate member washing apparatus 600 of Embodiment 7. The difference is that a liquid flow reduction plate 650 serving as a liquid flow reduction member is provided inside the cylindrical vessel 611, between the ejection tube 642 and a thin plate member fixing portion 630. As shown in FIG. 18, a plurality of circulation holes 650*a* is provided in the liquid flow reduction plate 650.

Effects

As described above, also when the mesh member 160 is washed using the thin plate member washing apparatus of the present embodiment, the first washing by only the liquid flow of the tap water 1300 and thereafter the second washing by the liquid flow containing a lot of air bubbles are performed because the pump mechanism 640 is used, and therefore, the mesh member 160 can be easily washed and the same effects as those of Embodiment 7 above can be obtained. Furthermore, the liquid flow can be dispersed and spread more widely because the liquid flow reduction member 650 is provided.

Note that the configuration in which the liquid flow reduction member 650 is provided can also be applied to thin plate member washing apparatuses of embodiments that will be described below.

Embodiment 9

Next, the structure of a thin plate member washing apparatus of Embodiment 9 will be described with reference to FIGS. 19 and 20. The thin plate member washing apparatus of Embodiment 9 has the same basic configuration as the above-described thin plate member washing apparatus 600 of Embodiment 7. The difference is that the thin plate member fixing portion 630 provided inside the cylindrical vessel 611 is rotatable about an axis V1 of the arm portion 631.

Effects

As described above, also when the mesh member 160 is washed using the thin plate member washing apparatus of the present embodiment, the first washing by only the liquid flow of the tap water 1300 and thereafter the second washing by the liquid flow containing a lot of air bubbles are performed because the pump mechanism 640 is used, and therefore, the mesh member 160 can be easily washed and the same effects as those of Embodiment 6 above can be obtained.

Figure 19:
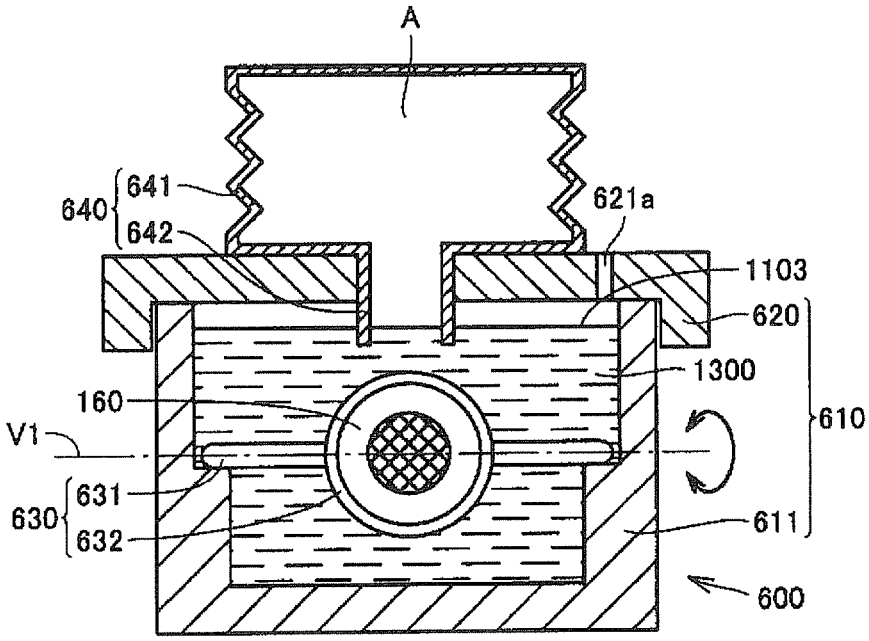
FIG. 19 is a first vertical cross-sectional view showing the configuration of a thin plate member washing apparatus of Embodiment 9.
Figure 20:
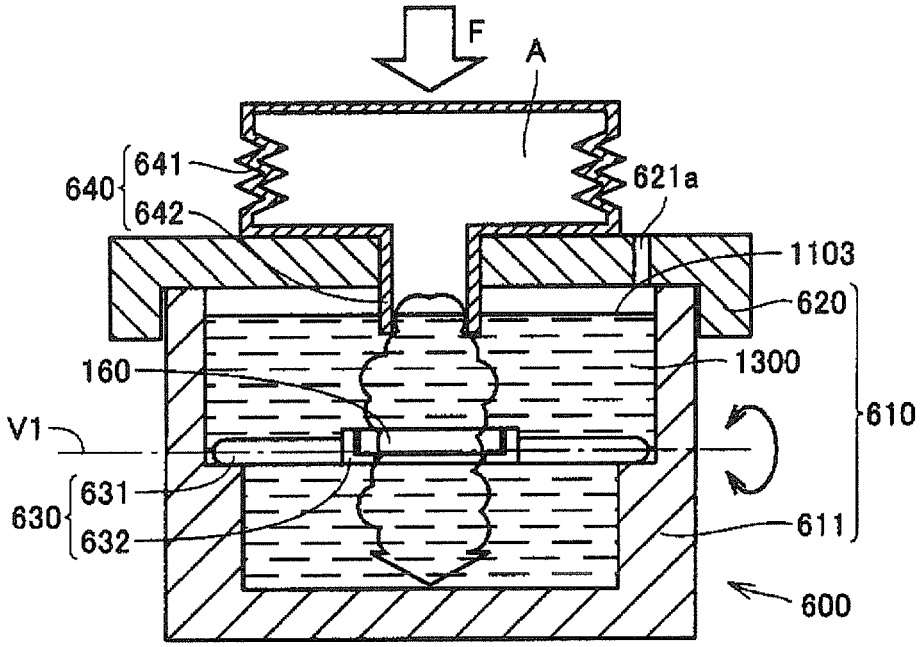
FIG. 20 is a second vertical cross-sectional view showing the configuration of the thin plate member washing apparatus of Embodiment 9.

Furthermore, the liquid flow from the pump mechanism 640 rotates the thin plate member fixing portion 630 about the axis V1 (from a state shown in FIG. 19 to a state shown in FIG. 20). This enables both sides of the mesh member 160 to be washed simultaneously, eliminates the need for an operation of changing between the front and back surfaces of the mesh member 160 as described in Embodiment 7 above, and can increase the washing efficiency in washing the mesh member 160.

Note that the rotation of the thin plate member fixing portion 630 can be promoted by employing a configuration in which the center position of the ejection tube 642 and the center position of the mesh member 160 are offset from each other. Moreover, the rotation of the thin plate member fixing portion 630 can also be promoted by providing the thin plate member fixing portion 630 with a blade portion.

As described above, with the thin plate member washing apparatus of the present embodiment, it is possible to efficiently wash a mesh member 160 without causing damage to the mesh member 160.

Embodiment 10

Figure 21:
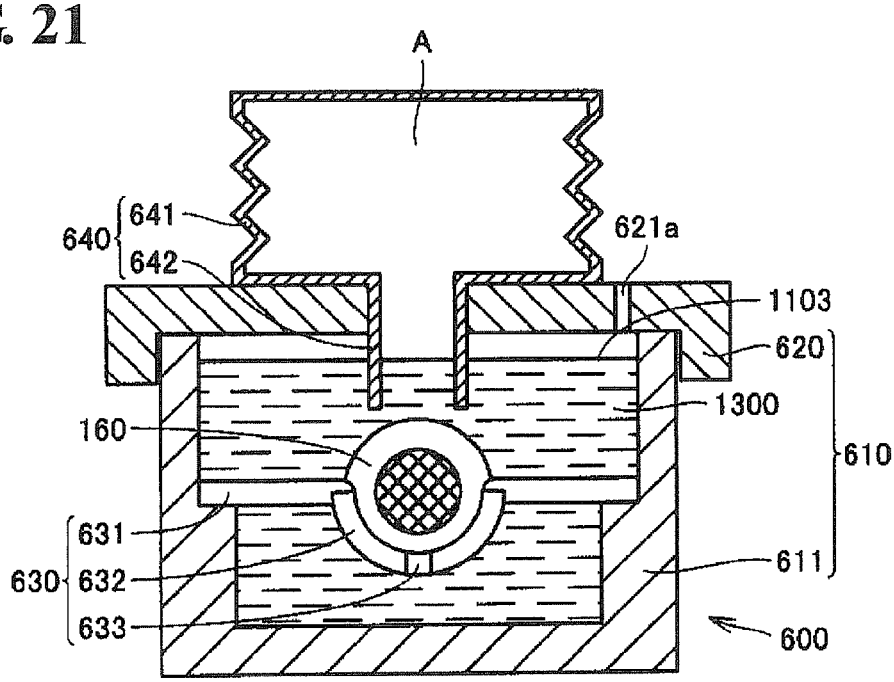
FIG. 21 is a first cross-sectional view showing the configuration of a thin plate member washing apparatus of Embodiment 10.

Next, the structure of a thin plate member washing apparatus of Embodiment 10 according to the present invention will be described with reference to FIGS. 21 and 22. The thin plate member washing apparatus of Embodiment 10 has the same basic configuration as the above-described thin plate member washing apparatus 600 of Embodiment 7. The difference is that as shown in FIG. 21 the mesh member 160 is held by the thin plate member fixing portion 630 in a vertical position.

Here, the phrase that the mesh member 160 is held in a vertical position means a state in which a plane containing the mesh member 160 extends in the vertical direction. Moreover, a swing protrusion 633 similar to that described in Embodiment 2 with reference to FIG. 9 is provided on a lower end of a semicircular holding portion 632 of the thin plate member fixing portion 630.

Effects

As described above, also when the mesh member 160 is washed using the thin plate member washing apparatus of the present embodiment, the first washing by only the liquid flow of the tap water 1300 and thereafter the second washing by the liquid flow containing a lot of air bubbles are performed because the pump mechanism 640 is used, and therefore, the mesh member 160 can be easily washed and the same effects as those of Embodiment 6 above can be obtained.

Figure 22:
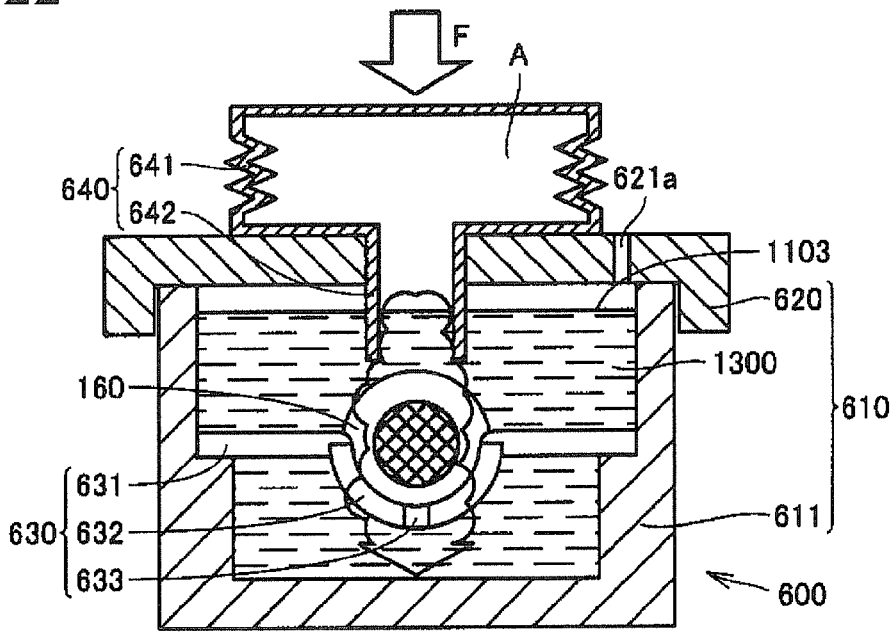
FIG. 22 is a second vertical cross-sectional view showing the configuration of the thin plate member washing apparatus of Embodiment 10.

Furthermore, as shown in FIG. 22, since the thin plate member fixing portion 630 holds the mesh member 160 in a vertical position and is provided with the swing protrusion 633, the liquid flow from the pump mechanism 640 flows over the both sides of the mesh member 160 at a time and therefore can simultaneously wash the both sides.

Moreover, due to the effect of the liquid flow that makes contact with the swing protrusion 633, the mesh member 160 swings, and washing can be enhanced even more. As a result, the need for an operation of changing between the front and back surfaces of the mesh member 160 as described in Embodiment 7 above is eliminated, and the mesh member 160 washing efficiency can be enhanced.

As described above, with the thin plate member washing apparatus of the present embodiment, it is possible to efficiently wash a mesh member 160 without causing damage to the mesh member 160.

Drying Step of Embodiments 7 to 10

Then, a drying step of drying the mesh member 160 after washing in the case where the thin plate member washing apparatus 600 of Embodiment 7 shown in FIG. 15 is used will be described with reference to FIG. 23. This drying step can be equally applied to the thin plate member washing apparatuses of Embodiments 8 to 10 as well.

Figure 23:
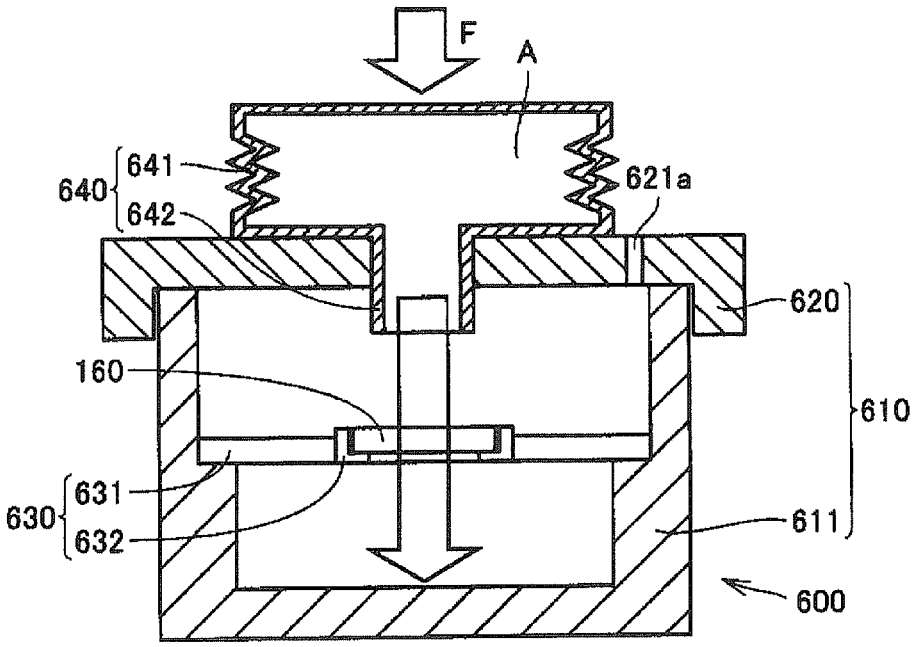
FIG. 23 is a cross-sectional view showing a drying step in which the thin plate member washing apparatus of each embodiment is used.

As shown in FIG. 23, the tap water 1300 is drained, and in this state, the bellows pump main body 641 is pressed in (the direction of arrow F in the drawing). Thus, air (A) is fed in from the ejection tube 642, and drying of the mesh member 160 after washing can be promoted.

Bellows Pump Main Body 641 Containing Washing Liquid

Figure 24:
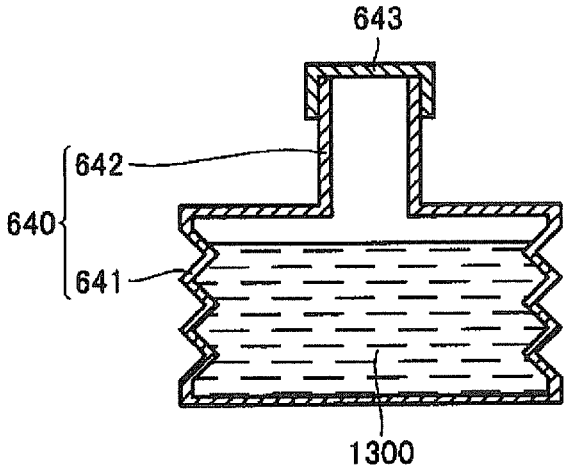
FIG. 24 is a vertical cross-sectional view showing a bellows pump storing a washing liquid that can be used for the thin plate member washing apparatus of each embodiment.

Then, with respect to the pump mechanism 640 used in the thin plate member washing apparatuses of Embodiments 7 to 10, the bellows pump main body 641 containing a washing liquid will be described with reference to FIG. 24. For example, as shown in FIG. 24, a washing liquid (washing water or a washing solution) is sealed in the bellows pump main body 641 in advance, and a hermetically sealed state is maintained by a cap 643. During use, the cap 643 is opened, the washing liquid inside is introduced into the cylindrical vessel 611, and the bellows pump main body 641 is mounted to the top panel portion 621 of the lid member 620.

Although the above embodiments have been described using the mesh member 160 for use in nebulizers as an example of the thin plate member to be washed, the thin plate member that can be used for the thin plate member washing apparatus according to the present invention is not limited to the mesh member for use in nebulizers, and the present invention is applicable to contact lenses and other thin plate members as well.

Although there have been described particular embodiments of the present invention, the embodiments disclosed herein are to be considered in all respects as illustrative and not restrictive. The scope of the present invention is defined by the appended claims, and all changes that fall within the meaning and scope equivalent to those of the claims are intended to be embraced therein.

REFERENCE SIGNS LIST

100 nebulizer
110 nozzle
120 open/close operation portion
130 medicinal fluid storage portion
140 stepped horn
150 piezoelectric element
160 mesh member
161 thin plate member
162 resin member
180 fluid collecting portion
190 partition plate
200 mouthpiece
210 atomizer-side opening
211 flange portion
220 inhalation port
230 air intake
240 tubular portion
500, 600 thin plate member washing apparatus
510, 610 washing vessel
511, 611 cylindrical vessel
512 shaft receiving recess
513 vertical wall
520, 620 lid member
521, 621 top panel portion
522, 622 cylindrical edge portion
523 pin
524 rotary handle
525 opening
526 rotation center shaft
527 rotary arm member
528 engagement pin
530, 530A, 530B, 530C mesh member holding portion
531 main body portion
532 accommodating recess
532*a* through hole
533 engagement hole
535 swing protrusion
536 elastic member
621*a* air hole
630 mesh member holding portion
631 arm portion
632 holding portion
633 swing protrusion
640 pump mechanism
641 bellows pump main body
642 ejection tube
643 cap
650 liquid flow reduction plate
650*a* circulation hole
1103 liquid surface line
1300 tap water

The invention claimed is:

1. A thin plate member washing apparatus comprising:

a lid member;

a washing vessel having a top end opening that can be closed by the lid member and in which a liquid can be collected;

a thin plate member fixing portion that is supported in the washing vessel and can hold a thin plate member to be washed with the liquid; and a liquid flow generation unit that is provided on the lid member of the washing vessel and is configured to generate a liquid flow over a front surface and a back surface of the thin plate member in order to wash the thin plate member, wherein the liquid flow generation unit includes a pump mechanism that is configured to generate a liquid flow over the front surface and the back surface of the thin plate member by introducing a gas into the liquid in the washing vessel;

the washing vessel includes the lid member and a cylindrical vessel having a top end opening that can be closed by the lid member and in which the liquid can be collected;

the pump mechanism includes:

a bellows pump main body that is disposed on the front surface side of the lid member; and an ejection tube penetrating the lid member from the bellows pump main body and reaching a liquid surface position of the liquid collected in the cylindrical vessel, and a region supporting the thin plate member fixing portion in a position under the ejection tube is provided inside the cylindrical vessel.

2. The thin plate member washing apparatus according to claim 1, wherein a liquid flow reduction member is provided inside the cylindrical vessel, between the ejection tube and the thin plate member fixing portion.

3. The thin plate member washing apparatus according to claim 1, wherein the thin plate member fixing portion is provided so as to be rotatable in accordance with the liquid flow from the ejection tube.

* * * * *